United States Patent [19]

Carson

[11] 4,442,734

[45] Apr. 17, 1984

[54] METHOD FOR MOUNTING HARD WEAR-RESISTANT INSERTS

[75] Inventor: Charles Carson, Fort Wayne, Ind.

[73] Assignee: Fort Wayne Wire Die, Inc., Fort Wayne, Ind.

[21] Appl. No.: 383,207

[22] Filed: May 28, 1982

[51] Int. Cl.[3] ..... B21K 5/20

[52] U.S. Cl. ..... 76/107 A; 29/DIG. 4; 29/DIG. 31

[58] Field of Search ..... 76/107 A, 107 R, 101 R, 76/101 B, DIG. 12; 29/464, 406, DIG. 31

[56] References Cited

U.S. PATENT DOCUMENTS

| | | | |
|---|---|---|---|
| 2,778,250 | 1/1957 | Ploegsma | 76/107 A |
| 4,129,052 | 12/1978 | Bieberich | 76/107 A |
| 4,365,502 | 12/1982 | Carson | 76/107 A |

FOREIGN PATENT DOCUMENTS

| | | | |
|---|---|---|---|
| 667809 | 3/1952 | United Kingdom | 76/107 A |

*Primary Examiner*—Roscoe V. Parker

*Attorney, Agent, or Firm*—Jeffers, Irish & Hoffman

[57] ABSTRACT

A method of mounting a hard, wear-resistant insert for use as a core tube, wire drawing die, and the like in which a cylindrical metal casing is provided with opposite front and back sides, the casing having a cylindrical cavity formed in the front side with a flat bottom spaced from the back side. A cylindrical plug is provided having top and bottom ends, the plug being proportioned to have a close fit in the casing cavity. The casing-plug assembly has a reference position with the casing cavity bottom facing upwardly and the plug bottom end facing downwardly. Prior to insertion of the plug in the cavity, either the plug or the casing is inverted from its reference position. A hard insert element is centered with respect to either the inverted end of the plug bottom or the casing cavity bottom and is adhered thereto. Either the plug or the casing is again inverted to the reference position, and the plug is inserted in the casing cavity with the bottom end and insert element facing the cavity bottom. The plug is secured in the cavity and openings are formed in the top end of the plug and the bottom side of the casing communicating with the insert element. In the preferred embodiment, the plug is inverted and the insert element is centered on and adhered to the bottom end thereof.

17 Claims, 13 Drawing Figures

METHOD FOR MOUNTING HARD WEAR-RESISTANT INSERTS

BACKGROUND OF THE INVENTION

1. Field of the Invention

This invention relates generally to wire drawing dies, core tubes, extrusion tips, enameling dies, and the like, of the type employing natural or man-made single crystal and polycrystalline diamonds, cubic boron nitride, or any other hard, wear-resistant material suitable for use as the hard insert element, and to methods of mounting such elements.

2. Description of the Prior Art

Wire drawing dies, core tubes, extrusion tips, enameling dies, guides, nozzles, and other wear-resistant parts employing natural or man-made single crystal and polycrystalline diamonds, cubic boron nitride, or other hard, wear-resistant material as the insert element have been manufactured for some years, typically comprising a metal casing in which the hard insert element is mounted, the casing being adapted to be mounted in a wire drawing machine, insulation extrusion machine, or the like. U.S. Pat. No. 4,129,052 assigned to the assignee of the present invention, and U.S. Pat. No. 4,365,502, also assigned to the assignee of the present invention, disclose prior wire drawing dies and methods of making such dies.

Present methods of assembling wire drawing dies, core tubes, and the like, involve the application of heat and pressure to melt powder metal so as to encapsulate the hard insert element. With the use of present methods, it has been found that a shift in the axis of the insert element may occur during the application of heat and pressure which may result in destruction of the insert element during drilling. It is therefore desirable to provide a method of mounting a hard insert element in which the axis of the element is accurately located concentric with the casing and in which minimum shift of the element occurs during the application of heat and pressure.

A core tube is used in extruding insulation over wire and includes a hard insert element which serves as a wire guide to keep the wire centrally located so as to provide uniform insulation thickness.

SUMMARY OF THE INVENTION

The general object of this invention is to provide an improved method of assembling a wire drawing die, core tube or the like which includes a simplified method rapidly and accurately to locate on-center and concentric with the casing, natural or a man-made single crystal and polycrystalline diamonds, or any other hard, wear-resistant material used or suitable for use as a hard insert element in wire drawing dies, core tubes and the like.

The method of the invention can be used with both transparent and opaque insert element materials; the only requirements are that the insert element be approximately symmetrical around a vertical axis, have at least one flat horizontal surface, and that both horizontal surfaces be approximately parallel. The method of the invention can be used with both solid and pre-drilled insert elements.

The advantage of the assembly method of the invention over prior assembly methods is that insert elements with tapered sides and with one surface significantly larger than the other, such as single crystal diamonds, can be positioned so that the larger surface of the insert element has the larger diameter opening formed therein. The larger diameter opening in the insert element usually faces toward the front of the assembly so that with the method of the invention, more efficient use is made of the insert element material, i.e., a larger opening can be provided with the same diamond of the same opening can be provided with a smaller diamond than in the case of the prior methods in which the larger diameter opening is formed in a smaller surface of the insert element.

The invention, in its broader aspects, is used in a method of mounting a hard insert element which includes the steps of providing a cylindrical metal casing with opposite front and back sides, the casing having a cylindrical cavity formed in the front side with a flat bottom spaced from the back side. A cylindrical plug is provided having top and bottom ends, the plug being proportioned to have a close fit in the cavity. A hard insert element is positioned in the casing cavity adjacent the bottom thereof, and the plug is inserted in the casing cavity with the bottom end spaced from the casing bottom and the insert element located in that space. The plug is secured in the casing cavity and the insert element is secured in the space, and tapered openings are formed in the top end of the plug and the bottom side of the casing communicating with the insert element. The plug-casing assembly has a reference position with the casing cavity bottom facing upwardly and the plug bottom end facing downwardly.

In accordance with the invention, prior to inserting the plug in the casing, either the plug or the casing is inverted so that either of the plug bottom end or the casing cavity bottom is inverted from its reference position. The insert element is centered with respect to the inverted one of the plug bottom and casing cavity bottom and adhered thereto, following which the inverted one of the plug and casing is again inverted to its reference position.

In the preferred embodiment of the invention, the plug is inverted and the insert element is centered on and adhered to the plug bottom end.

It is accordingly an object of the invention to provide an improved method of mounting a hard insert element.

Another object of the invention is to provide an improved method of mounting a hard insert element incorporating an improved method of rapidly and accurately locating the axis of the element concentric with the casing of the assembly.

Another object of the invention is to provide an improved method of mounting a hard insert element using natural or man-made single crystal and polycrystalline diamonds, cubic boron nitride, or any other hard, wear-resistant material suitable for use as an insert element.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

It will be understood that the drawings are not to scale and that certain elements have been proportionally enlarged for ease of illustration.

Figure 1:
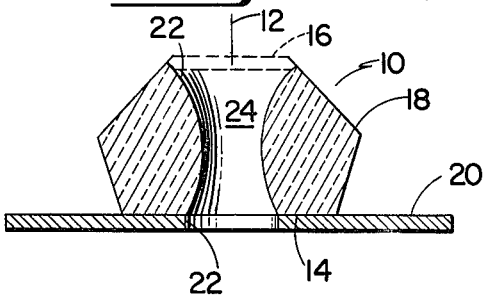
Fig. 1 PRIOR ART
FIG. 1 is an enlarged, somewhat schematic cross-sectional view of a single crystal diamond, useful in explaining one of the advantages of the invention.

Referring now to FIG. 1, there is shown a single crystal diamond 10 having vertical axis 12, flat, parallel bottom and top surfaces 14, 16, and tapered sides 18 extending between bottom and top surfaces 14, 16. Typically, one flat surface 14 is substantially larger than the other flat surface 16.

In prior method of assembling wire drawing dies, core tubes and the like, such as that disclosed in the aforesaid application, it is customary to place the larger flat surface 14 on a flat surface, such as circular disc 20 having opening 22 therein, diamond 10 being centered so that axis 12 was concentric with opening 22. When the conventional opening 24 was drilled, the larger upper end 22 would frequently communicate with tapered sides 18 of diamond 10, rather than being confined to smaller flat surface 16, thus resulting in waste of considerable valuable diamond material. The present invention is intended to eliminate such wastage.

Figure 2A:
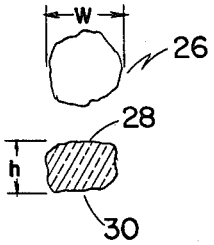
FIG. 2A through FIG. 2E show various forms of hard insert elements usable in the method of the invention.
Figure 2B:
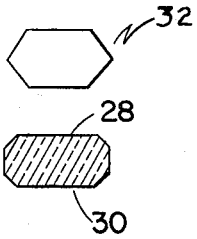
Figure 2C:
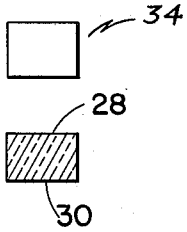
Figure 2D:
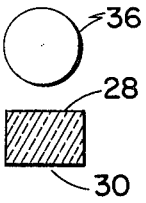
Figure 2E:
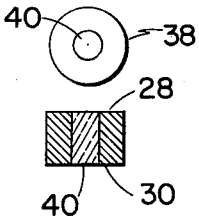

Referring now to FIGS. 2A through 2E, there are shown top and cross-sectional views of several forms of hard insert elements usable in the method of the invention. FIG. 2A shows a transparent, irregularly shaped insert element 26 having parallel surfaces 28, 30, a maximum width dimension "w", and a maximum height dimension "h". FIG. 2B shows an opaque or transparent, symmetrically shaped insert element 32 also having parallel surfaces 28, 30. FIG. 2C shows an opaque, square insert element 34 having parallel surfaces 28, 30, and FIG. 2D shows an opaque, cylindrical insert element 36 having parallel surfaces 28, 30. FIG. 2E shows opaque, cylindrical duplex insert element 38 having core 40 which may be formed of man-made polycrystalline diamond. It will be understood that any of the insert elements or blanks shown in FIG. 2 may have a predrilled die or guide hole therethrough.

Figure 3A:
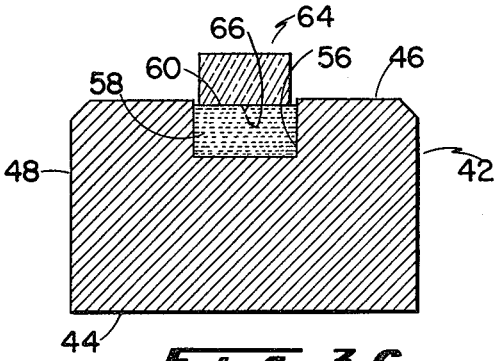
FIG. 3A through FIG. 3C illustrate different methods of forming a plug-insert element assembly.
Figure 3B:
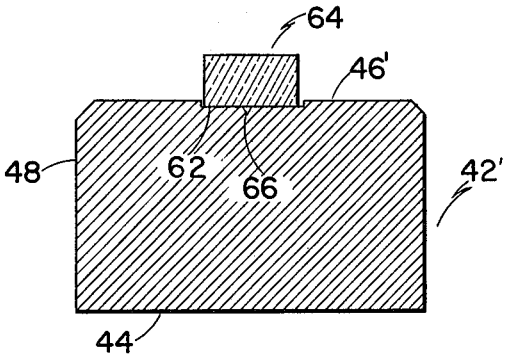
Figure 3C:
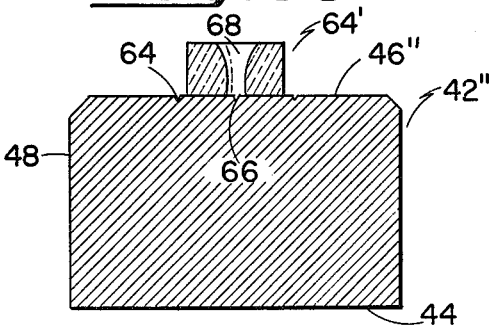

Referring now to FIGS. 3A, 3B and 3C, cylindrical metal plug 42, 42' or 42" is provided having top end 44, bottom end 46, 46', 46" and cylindrical side wall 48 having a diameter proportioned to have a close fit with the cylindrical side wall of cavity 50 formed in casing 54 to be described shortly.

In a preferred embodiment, cylindrical recess 56 is formed in bottom end 46 with its axis concentric with the axis of plug 42. The diameter of recess 56 is slightly larger than the maximum width dimension "w" of the die element to be used, and the depth of recess 56 is slightly deeper than the maximum thickness "h" of the die element. In a specific embodiment, the diameter of recess 56 is about 0.060 inch larger than the largest width or horizontal dimension "w" and the depth is about 0.002 inch greater than thickness "h". Recess 56 is filled with low melting point powder metal 58 which is cold-compacted with pressure which may be on the order of 200,000 pounds per square inch and sufficient powder metal is added so that after addition and compaction twice, the top surface 60 of compacted powder metal 58 is slightly below the level of bottom end 46 of plug 42. In the specific embodiment, top surface 60 of compacted powder metal 58 is about 0.020 inch below the level of bottom end 46. This compaction and addition of powder metal is necessary to insure that a sufficient quantity of powder metal has been added completely to encapsulate the die element after melting and resolidification.

In the preferred embodiment, powder metal 58 is a mixture of:

1. Sixty five percent (65%) pre-alloyed powder containing about seventy six percent (76%) nickel, fourteen percent (14%) chromium, and ten percent (10%) phosphorous which supplies the liquid metal phase and melts at about 1630° F. This component has high fluidity and strength.
2. Twenty five percent (25%) of either pure nickel powder or a nickel-based alloy, such as Inconel. This component adds ductility to the molten component.
3. Ten percent (10%) copper to aid in cold-compacting the mixture.

Alternatively, powder metal 58 may be a mixture of:

1. Forty percent (40%) of a pre-alloyed low melting alloy containing forty five percent (45%) silver, fifteen percent (15%) copper, sixteen percent (16%) zinc, and twenty four percent (24%) cadmium to supply the liquid metal phase which melts at 1150° F. This component has high fluidity and ductility.
2. Fifty percent (50%) nickel or nickel-based alloy used as a filler.
3. Ten percent (10%) copper to aid in cold-compacting the mixture.

Other plug embodiments which may be employed in the invention are shown at 42' in FIG. 3B and 42" in FIG. 3C. In the embodiment of the plug 42' shown in FIG. 3B, shallow recess 62 is formed in bottom end 46' of plug 42' again having axis concentric with the axis of the plug. In a specific embodiment, the depth of recess 62 is about 0.020 inch. No powder metal is used with the embodiment shown in FIG. 3B. In the embodiment shown in FIG. 3C, annular groove 64 is formed in bottom end 46" of plug 42" again having its axis concentric with the axis of the plug. The diameter of annular groove 64 is slightly larger than the maximum width or horizontal dimension of the die element. In a specific embodiment, the diameter of annular groove 64 is about 0.020 inch larger than the maximum width dimension "w" of the die element to be used.

The material of which plug 42, 42', 42" is formed may be any ferrous or non-ferrous metal. In a specific embodiment, the plug is formed of 303 stainless steel. In certain severe applications, the plug material may be a heat-hardenable alloy which will import greater hoop strength around the insert element.

In each embodiment of the plug shown in FIG. 3, insert 62 is adhered to the recessed or grooved end of the plug so that the axis of the die element is coincident with the axis of the plug.

In order to mount, secure and properly align a transparent insert element with plug 42, 42', 42" a shallow centering mark or scribe 66 is machined or otherwise formed in top surface 60 of powder metal 58, or in the bottom surface of recess 62, or on top surface 46", in each case coincident with the axis of the plug. A small drop of quick-setting, volatile cement, such as a cyanoacrylate type adhesive is then placed over centering mark 66. Slight pressure is applied to the insert element to secure it in place. As shown in FIG. 3C, insert element 64' having pre-drilled hole 68 therein may be placed over centering mark 66 of any of the embodiments of the plug.

In the case of an opaque insert element, the centering method shown in FIGS. 3A and 3B are employed. Here, centering mark 66 is omitted and recess 56 of plug 42 or recess 62 of plug 42' is proportioned to have a close fit with the largest width dimension "w" of the insert element. A small drop of quick-setting, volatile cement is then placed approximately on center on top surface 60 of compacted powder metal 58 or the bottom surface of recess 62 and the die element is then hand-placed on top of top surface 60 of compacted powder metal 58 or in recess 62. Slight pressure is again applied to the insert element until the cement hardens.

It will be observed that in each of the above-described methods of centering an insert element with respect to the top surface of the plug and adhering the die element thereto, the plug is inverted so that its bottom end 46 is facing upwardly.

Figure 4:
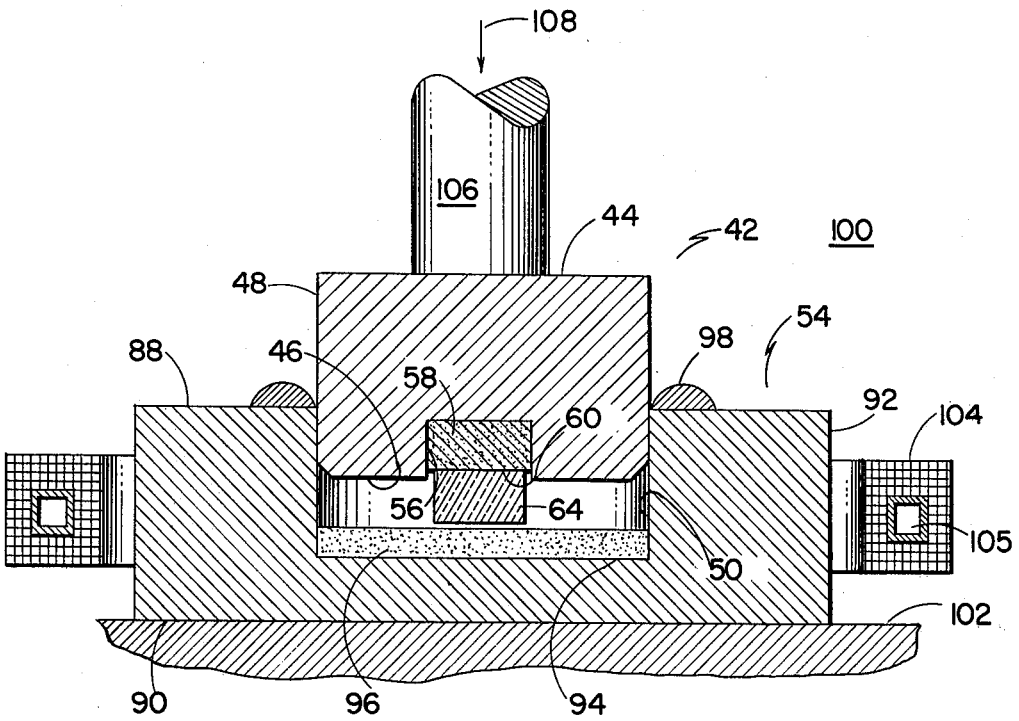
FIG. 4 is a cross-sectional view showing one embodiment of the method of the invention.

Referring now to FIG. 4, cylindrical metal casing 54 is provided having flat, parallel front and back sides 88, 90 and cylindrical side wall 92. Cylindrical cavity 50 is formed in front side 88 of casing 54 coaxial with cylindrical side wall 92 and has bottom 94 spaced from back side 90, as shown.

Loose powder metal 96, which may be similar to powder metal 58 in plug recess 56, is loosely placed on bottom 94 of cavity 50, the depth of powder metal 96 being approximately equal to the thickness of insert element 64. Plug 42, 42', 42" with the insert element 64 centered and adhered thereto, as above described, is then inverted and hand-inserted in casing cavity 50. In a specific embodiment, the outside diameter of plug 42 is 0.002 inch smaller than the inside diameter of cavity 50 for ease of insertion and joinability to each other. As seen in FIG. 4, bottom end 46 and insert element 64 face bottom 94 of casing cavity 50 and powder metal layer 96.

Ring 98 of brazing flux is then placed on front side 88 of casing 54 surrounding plug 42. In the case of powder metals having a melting point above 1600° F., "Nicro-braze Flux" manufactured by Wall Colomonoy Corp., Detroit, Mich., has been found to be suitable. In the case of powder metals having a melting point below 1400° F., "DB Flux" manufactured by Handy and Harmon Corp., New York City, N.Y., has been found to be suitable.

The plug, insert element and casing assembly 100 is then heated and hot-pressed. In the preferred embodiment, the back side 90 of casing 54 is placed on support 102 and induction coil 104 having water cooling tube 105 therein surrounds casing 92. Carbide plunger 106 actuated by a suitable press (not shown) applies pressure on top end 44 of plug 42, as shown by arrow 108. Typical maximum temperatures at the plug-casing interface are:

1. 1725° F. for powder metal having a melting point of 1630° F.
2. 1300° F. for a powder metal melting point of 1152° F.

Typical maximum pressure applied to plug 42 by plunger 106 is about 5,000 pounds per square inch. It will be readily understood that the temperature and pressure may be raised or lowered as the need arises.

Figure 7:
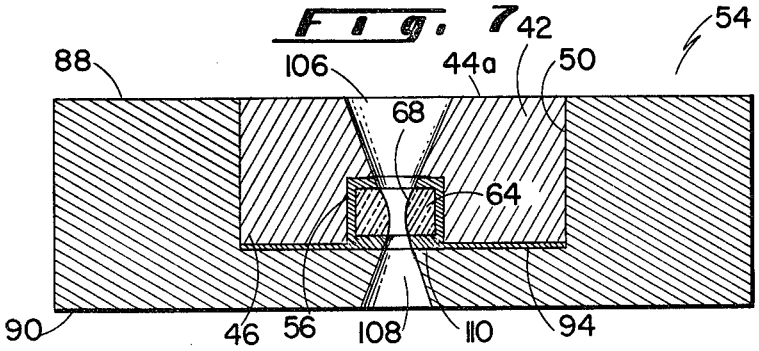
FIG. 7 is a cross-sectional view showing one embodiment of a finished wire drawing die assembled by use of the method of the invention.

Referring now to FIG. 7, following the application of pressure and heat as above described, the top end of plug 42 is machined flush with front side 88 of casing 54, as shown at **44*a*, tapered openings 106, 108 are drilled in front side 88 and back side 90 of casing 54, respectively, to insert element 64 and hole 68 as drilled in insert element 64 communicating with openings 106, 108 in the event that a pre-drilled insert element has not been employed. It will be seen that the melted, solidified powder metal encapsulates insert element 64 in plug recess 56 and fills the space between bottom end 46 of plug 42 and bottom 94 of casing cavity 50, as at 110**.

Figure 5:
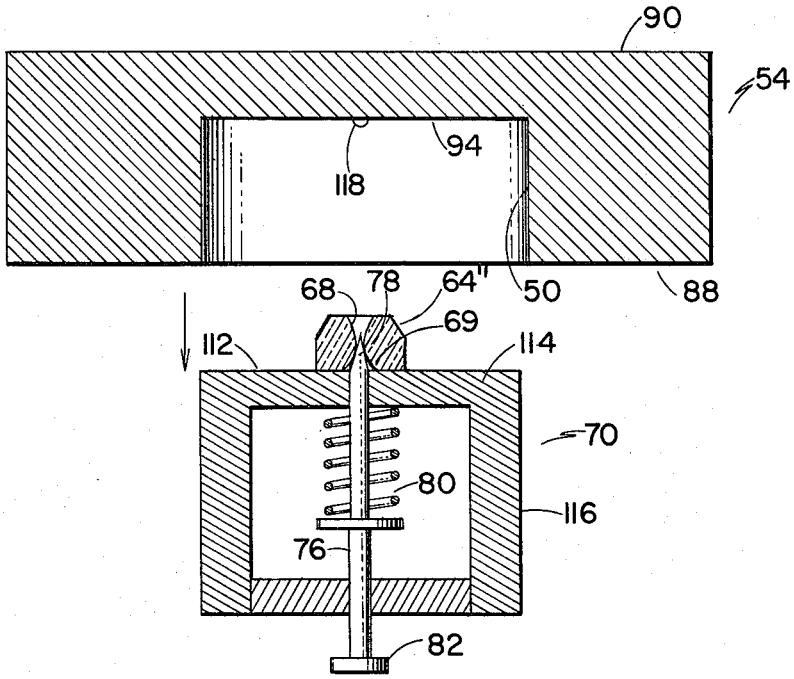
FIG. 5 is a cross-sectional view showing the preferred method of centering a pre-drilled insert element on the bottom of the casing cavity.
Figure 6:
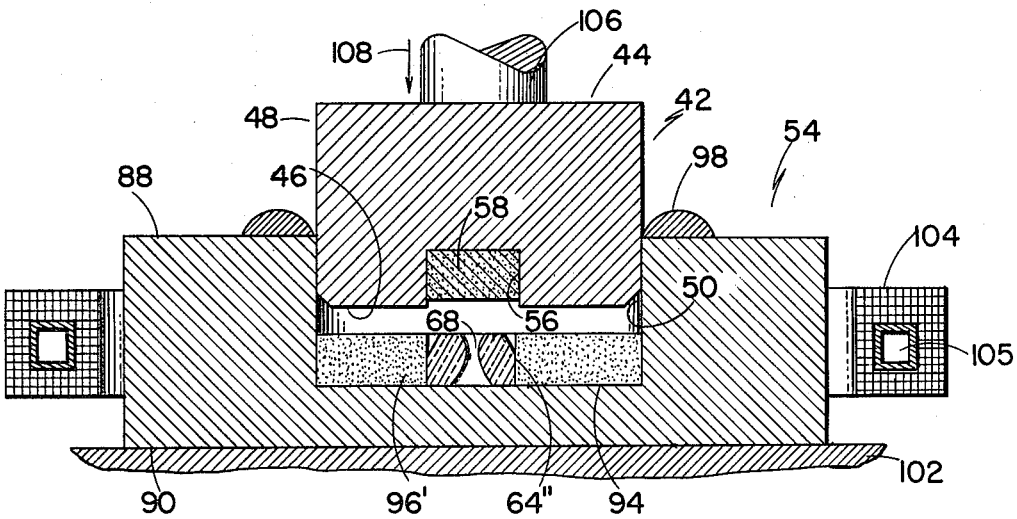
FIG. 6 is a cross-sectional view showing another embodiment of the method of the invention.

Referring now to FIGS. 5 and 6 in which like elements are indicated by like reference numerals and similar elements by primed reference numerals, there is shown another embodiment of the method of the invention in which pre-drilled insert element 64", such as a natural diamond, is centered on and adhered to bottom 94 of cavity 50 of casing 94. Here, pre-drilled insert element 64" is placed with its larger diameter opening 69 facing downwardly on surface 112 of end wall 114 of cylindrical alignment fixture 70. Side wall 116 of alignment fixture 70 is proportioned to have a close fit with cavity 50 of casing 54. Knob 82 of pin 76 is then manually depressed againt spring 80 so that pointed end 78 of pin 76 enters die hole 68 in insert element 64" thus accurately centering the die element.

In order to prevent tilting of the pre-drilled insert element 64" during assembly into case 54, in the embodiment of the method shown in FIG. 6, bottom 94 of cavity 50 is preferably flattened by a press with a pressure of about 76,000 lbs. pounds per square inch at room temperature.

A small drop of quick-setting, volatile cement is placed approximately on the center of bottom 94 of casing cavity 50, as at 118 and casing 54 is then inverted over pre-drilled insert element 64" on alignment fixture 70, as shown in FIG. 5, and casing cavity 50 is then inserted over cylindrical alignment fixture 70 with insert element 64" being cemented in place on bottom 94 of casing cavity 50 with gentle pressure. The alignment fixture is then withdrawn leaving insert element 64' adhered to bottom 94 of casing cavity 50.

Casing 54 is then again inverted and bottom side 90 placed on support 102, as shown in FIG. 6. Powder metal 96' is then deposited on bottom 94 of casing cavity 50 so as to just cover insert element 64", as shown. Plug 42 having powder metal 58 in recess 56 in bottom end 46 is then inverted and inserted in casing cavity 50, brazing flux 98 is placed on front side 88 of casing 54 surrounding plug 42, and heat and pressure are applied by induction coil 104 and press plunger 106, as above described.

After application of heat and pressure to both melt and consolidate powder metal 58, 96' and then removal of the heat followed by removal of the pressure to uniformly solidify the melted powder metal, the die, core tube or the like is completed as above-described in connection with FIG. 7.

It has been observed that no observable laterial movement of the solid insert elements, i.e., which are not pre-drilled occurs after assembly of the wire drawing die, core tube or the like. It has also been observed that the maximum lateral displacement of pre-drilled insert elements assembled as described above in connection with FIG. 6 is about 0.002 inch after assembly.

While there have been described above the principles of this invention in connection with specific apparatus, it is to be clearly understood that this description is made only by way of example and not as a limitation to the scope of the invention.

What is claimed is:

1. In a method of mounting a hard insert element including the steps of providing a cylindrical metal casing with opposite front and back sides, the casing having a cylindrical cavity formed in the front side with a flat bottom spaced from the back side, providing a cylindrical plug having top and bottom ends and proportioned to have a close fit in the caity, positioning an insert element in the casing cavity adjacent the bottom thereof, inserting the plug in the casing cavity with the bottom end thereof spaced from the cavity bottom with the die element located in the space, securing the plug in the cavity and the insert element in the space, and forming tapered openings in the top end of the plug and the bottom side of the casing respectively communicating with the insert element, the plug-casing assembly having a reference position with the casing cavity bottom facing upwardly and the plug bottom end facing downwardly, the improvement comprising: prior to inserting the plug in the cavity, inverting one of said plug and casing so that one of said plug bottom end and casing cavity bottom is inverted from its reference position; centering said insert element with respect to the inverted one of said plug bottom end and casing cavity bottom and adhering said insert element thereto; and again inverting said one of said plug and casing to said reference position.

2. The method of claim 1 wherein the securing step comprises depositing powder metal on the casing cavity bottom prior to inserting the plug in the cavity, applying brazing flux on the top surface of the casing surrounding the plug after insertion thereof; applying pressure on the plug and heat to the casing thereby to melt the powder metal and brazing flux, and cooling the assembly to solidify the melted powder metal and brazing flux prior to forming the openings.

3. The method of claim 2 wherein the bottom end of the plug has a coaxial cylindrical recess formed therein having a diameter and depth proportioned to accommodate the insert element, the further improvement comprising: prior to inserting the plug in the casing, depositing powder metal in said recess and compacting the same so that the compacted powder metal nearly fills said recess, said insert element being positioned in said recess after application of the pressure and heat and being encapsulated in the solidified melted powder metal therein.

4. The method of claim 1 wherein said insert element is adhered to said one of said plug bottom end and cavity bottom by a quick-setting, volatile cement.

5. The method of claim 1 wherein said plug is inverted and said insert element is centered on and adhered to said plug bottom end.

6. The method of claim 5 comprising the further step of forming a coaxial cylindrical recess in said plug bottom end, said recess having a diameter slightly larger than the maximum width dimension and a depth slightly deeper than the maximum thickness dimension of said insert element, said centering step comprising positioning said insert element in said recess and adhering the same therein.

7. The method of claim 6 comprising the further step of depositing powder metal in said recess and compacting the same so that the powder metal nearly fills said recess, said centering step comprising placing said insert element on the top of the compacted powder metal and adhering the same thereto, said securing step comprising heating said casing and plug thereby to melt said powder metal and applying pressure to said plug so that said insert element is encapsulated with melted powder metal in said recess, and cooling said assembly thereby to solidify said melted powder metal.

8. The method of claim 7 comprising the further step of placing a centering scribe on said top of said compacted powder metal coaxial with said recess.

9. The method of claim 5, comprising the further step of forming a shallow, coaxial, cylindrical recess in said plug bottom end having a diameter slightly larger than the maximum width dimension of said insert element, said centering step comprising positioning said insert element in said recess and adhering the same therein.

10. The method of claim 9 comprising the further step of placing a coaxial centering scribe on the bottom of said recess.

11. The method of claim 5 comprising the further step of forming a coaxial recess in said plug bottom end having a maximum width slightly larger than the maximum width dimension of said insert element, said centering step comprising positioning said insert element in said recess and adhering the same therein.

12. The method of claim 5 wherein said plug bottom end is substantially flat, and comprising the further steps of forming a coaxial annular groove in said plug bottom end having a diameter slightly larger than the greatest width dimension of said insert element, and placing a coaxial centering scribe on said plug bottom at the center of said annular groove.

13. The method of claim 5 wherein said insert element is symmetrical about a vertical axis, said insert element having spaced, generally parallel surfaces normal to said axis, at least one of said surfaces being flat, said insert element having tapered sides extending between said surfaces, said flat surface being larger than the other surface and being adhered to said plug bottom end.

14. The method of claim 1 wherein said casing is inverted and said insert element is centered on and adhered to said cavity bottom.

15. The method of claim 1 wherein the bottom end of the plug has a coaxial cylindrical recess formed therein having a diameter and depth proportioned to accommodate the insert element, and wherein the securing step comprises depositing powder metal on the casing cavity bottom prior to inserting the plug in the cavity, applying brazing flux on the top surface of the casing surrounding the plug after insertion thereof, applying pressure on the plug and heat to the casing thereof to melt the powder metal and brazing flux prior to forming the openings, the further improvement comprising: prior to inserting the plug in the casing, depositing powder metal in said recess and compacting the same so that said powder metal substantially fills said recess, said insert element being positioned in said recess after application of the pressure and heat and being encapsulated in the solidified melted powder metal therein.

16. The method of claim 15 wherein said insert element has a pre-drilled hole therethrough, and wherein said centering step comprises providing a cylindrical alignment fixture having a diameter proportioned to have a close fit in said casing cavity and having an end and a bore, said fixture having a coaxial alignment pin having a pointed end extending through said fixture end from said bore, placing adhesive on the center area of said cavity bottom, positioning said insert element on said fixture end with said pin end entering said hole, inserting said fixture in said casing cavity with said fixture end and insert element facing said cavity bottom until said insert element engages said adhesive, and removing said fixture following adherence of said insert element to said cavity bottom.

17. The method of claim 15 wherein said insert element is symmetrical about a vertical axis, said insert element having spaced, generally parallel surfaces normal to said axis, at least one of said surfaces being flat, said insert element having tapered sides extending between said surfaces, said flat surface being smaller than the other surface and being adhered to said cavity bottom.

* * * * *

UNITED STATES PATENT AND TRADEMARK OFFICE

CERTIFICATE OF CORRECTION

PATENT NO. : 4,442,734

DATED : April 17, 1984

INVENTOR(S) : Charles Carson

It is certified that error appears in the above—identified patent and that said Letters Patent is hereby corrected as shown below:

Col. 6, line 36, change "againt" to --against--.

Col. 7, claim 1, line 22, change "caity" to --cavity--.

Signed and Sealed this

*Eleventh* Day of *September 1984*

[SEAL]

*Attest:*

GERALD J. MOSSINGHOFF

*Attesting Officer*

*Commissioner of Patents and Trademarks*